US008310132B2

(12) United States Patent
Martin et al.

(10) Patent No.: US 8,310,132 B2
(45) Date of Patent: Nov. 13, 2012

(54) INSONIFICATION DEVICE HAVING AN INTERNAL COOLING CHAMBER

(75) Inventors: Yves Martin, Beynost (FR); Mathieu Pernot, Paris (FR)

(73) Assignee: Super Sonic Imagine (FR)

( * ) Notice: Subject to any disclaimer, the term of this patent is extended or adjusted under 35 U.S.C. 154(b) by 112 days.

(21) Appl. No.: 12/922,966

(22) PCT Filed: Mar. 17, 2009

(86) PCT No.: PCT/EP2009/053145

§ 371 (c)(1),
(2), (4) Date: Sep. 16, 2010

(87) PCT Pub. No.: WO2009/115523

PCT Pub. Date: Sep. 24, 2009

(65) Prior Publication Data

US 2011/0011111 A1 Jan. 20, 2011

Related U.S. Application Data

(60) Provisional application No. 61/151,287, filed on Feb. 10, 2009.

(30) Foreign Application Priority Data

Mar. 18, 2008 (FR) ..... 08 51744

(51) Int. Cl.
*F25D 31/00* (2006.01)

(52) U.S. Cl. ..... 310/334; 310/341; 310/342; 310/346; 62/259.2; 165/104.28

(58) Field of Classification Search ..... 310/334, 310/341, 342, 346; 62/259.2; 165/104.28, 165/104.33

See application file for complete search history.

(56) References Cited

U.S. PATENT DOCUMENTS

| | | | | |
|---|---|---|---|---|
| 7,235,914 | B2 * | 6/2007 | Richards et al. | 310/328 |
| 2005/0163683 | A1 * | 7/2005 | McCausland | 422/245.1 |
| 2006/0126884 | A1 * | 6/2006 | Hielscher | 381/397 |
| 2007/0295328 | A1 * | 12/2007 | Raghuprasad | 128/200.21 |

FOREIGN PATENT DOCUMENTS

| | | |
|---|---|---|
| DE | 10242072 | 4/2004 |
| JP | 62155000 | 7/1987 |

* cited by examiner

*Primary Examiner* — Walter Benson
*Assistant Examiner* — Bryan Gordon
(74) *Attorney, Agent, or Firm* — Caesar, Rivise, Bernstein, Cohen & Pokotilow, Ltd.

(57) ABSTRACT

The invention relates to an insonification device (100) comprising a plurality of elementary ultrasonic transducers (110) each comprising at least one electro-acoustic element (111) and distributed on a chassis (120, 140) so that the electro-acoustic elements (111) are distributed on a so-called front surface (120') of the device (100) intended to be placed facing the medium to be insonified. According to the invention, as each transducer (110) comprises a longitudinal body (113) made in a heat conducting material at the so-called front end of which the electro-acoustic element (111) is placed, the chassis (120, 140) comprises a sealed cooling chamber (130) placed behind the front surface (120'), crossed by the bodies of the transducers (113) and intended to be gone through by a coolant fluid flow.

21 Claims, 3 Drawing Sheets

INSONIFICATION DEVICE HAVING AN INTERNAL COOLING CHAMBER

CROSS-REFERENCE TO RELATED APPLICATIONS

This national stage application claims the benefit under 35 U.S.C. §371 of International Application No. PCT/EP2009/053145 filed on Mar. 17, 2009, entitled INSONIFICATION DEVICE HAVING AN INTERNAL COOLING CHAMBER, which in turn takes its priority from French Application No. 08 51744 filed on Mar. 18, 2008 and U.S. Provisional Application No. 61/151,287 filed on Feb. 10, 2009, and all of whose entire disclosures are incorporated by reference herein.

BACKGROUND OF THE INVENTION

The invention relates to the general field of insonification devices having a plurality of elementary ultrasonic transducers each having at least one electro-acoustic component, the plurality of transducers being distributed on a chassis so that the electro-acoustic components are distributed on a so-called "front" surface of the insonification device intended to be placed facing the medium to be insonified.

Electro-acoustic components, which are generally made in piezo-electric, piezo-composite materials or from semiconducting materials, for example capacitive micro-machined ultrasonic transducers (CMUTs), allow generation of high power ultrasonic waves with limited electro-acoustic efficiency.

Typically, for frequencies comprised between 100 kHz and 10 MHz, the electro-acoustic efficiency is between 40 and 80% for these materials. Also, a large portion of the energy which is not converted into ultrasonic waves is dissipated as heat in the transducer.

Too large heating during continuous operation of the electro-acoustic component for a period of several seconds may damage it, or even destroy it and this heating may even possibly deteriorate the mechanical portions which make it up or the adjacent ones.

This heating effect therefore presently limits the possibilities of generating very high acoustic intensities for long periods of several seconds. It is generally recognized that it is difficult to generate a power greater than 5 W/cm$^2$ at the surface of the transducer for periods of the order of a few tens of seconds without too large heating.

There are solutions for dissipating the produced heat in order to lower the temperature at the transducer. A known solution consists of having a cooled fluid, generally water, circulate on the "front" face of the insonification device. In this case, with the liquid, ultrasonic coupling may be achieved with the medium into which the ultrasonic waves are focused.

However, the heat exchange surface remains limited to the "front" surface of the insonification device and does not allow sufficient removal of heat in the case when very high acoustic intensities have to be used.

OBJECT AND SUMMARY OF THE INVENTION

The main object of the present invention is therefore to overcome such drawbacks by proposing an insonification device comprising a plurality of elementary ultrasonic transducers each comprising at least one electro-acoustic element, the plurality of transducers being distributed on a chassis so that the electro-acoustic elements are distributed on a so-called front surface of the device extending over at least two dimensions and intended to be placed facing the medium to be insonified, the insonification device being such that each transducer comprising a longitudinal body made in a heat conducting material at the so-called front end, from which the electro-acoustic element is placed, the chassis comprises a sealed cooling chamber placed behind the front surface, crossed right through by the body of the transducers and intended to be gone through by a flow of coolant fluid.

This novel structure of the insonification device wherein bodies of transducers are passing through cooling chamber allows transfer of a significant amount of heat by using the dissipation of the heat towards the rear of the transducers. Indeed, the heat produced by the active portion of the transducer which is the acoustic element located on the front surface, is drained off towards the rear by the material formed by the body of the elementary transducer.

With the invention, it is possible to obtain a heat exchange surface between the body of the transducers and a coolant liquid. Heat exchange is thereby achieved over a much larger surface than when a conventional cooling system from the front is used. In addition, as the coolant liquid is put into direct contact with the heat sources which are the transducers, the transfer of heat produced by the transducers towards a coolant liquid is thereby optimized.

Thus, with this novel cooling system, it is possible to limit heating of the elementary transducers and to reach much higher acoustic intensities at the surface of the transducers. With the invention, it is thereby possible to attain a power of about 20 W/cm$^2$.

In the sense of the invention, the term "chassis" designates a mechanical structure capable of supporting the transducers and of forming a casing of the cooling chamber which is crossed right through by the bodies of the transducers.

According to a preferential embodiment of the invention, the bodies of the transducers are profiled so as to facilitate circulation of the fluid.

With such a characteristic, it is at the very most avoided that the bodies of the transducers form obstacles to the circulation of the fluid within the cooling chamber.

According to a particular feature of the invention, the bodies of the transducers have a neck in at least one direction, the one perpendicular to the direction of flow, in order to reduce hydraulic resistance.

Such a neck allows flow between each pair of transducers with reduced hydraulic resistance. This necking may consist of shrinking the width of the body of the transducer along a direction perpendicular to the preferential direction of flow of the fluid or of even reducing the diameter of the body of the transducer.

The stresses due to the constitution of the transducers may require that the neck be made in the rear portion of the latter, i.e. at a distance from the heat source. Nevertheless, insofar that the material forming the body of the transducers is a good heat conductor, this feature which consists of placing the neck towards the rear end of the transducer is not a penalty.

According to an advantageous feature of the invention, the bodies of the transducers have a surface geometry with which an exchange surface with the fluid may be larger than the exchange surface corresponding to a surface geometry corresponding to a homogeneous and constant section along the transducer.

Such a feature which may consist of striating the bodies of the transducers in the flow direction of the coolant fluid, contributes not only to increasing the exchange surface and the heat transfer towards the coolant fluid but may also contribute to promoting circulation of the coolant fluid by guiding its circulation on the sides of the bodies of the transducers.

According to an advantageous feature of the invention, as the chassis comprises as many orifices at the rear of the insonification device as there are elementary transducers, the transducers are attached through the cooling chamber removably.

With this feature, the maintenance of the insonification device may be facilitated. Indeed, as the latter contains a large number of elementary transducers operating at high intensities, it is potentially subject to individual failures of these transducers which then have to be replaced. This feature allows easy and quick replacement, which may be carried out by a workforce not necessarily skilled for this. This avoids entire deposition of the device for repair or use of the device with degraded characteristics.

In an advantageous embodiment, the seal between the transducers and the chassis is provided by a flexible material placed in the space separating each transducer from the chassis and allowing differential heat expansions between the materials forming the elementary transducer modules and the materials forming the chassis. Grooves adapted for receiving such a flexible material, for example a flexible adhesive or an O-ring gasket, may be made on the body of the transducers and/or on the perimeter of the orifices.

Advantageously, the bodies of the transducers are made in a material selected from the following heat conducting materials: metals, ceramics, filler-loaded resins.

The listed materials have a significant heat conductivity, which allows good removal of the heat through the rear of the elementary transducers. It is noted here that the bodies of the transducers may either be electric conductors or not.

According to a feature of the invention, the electro-acoustic elements of the transducers are made in a material selected from piezo-electric materials, piezo-composite materials, semiconducting materials including CMUTs.

According to an advantageous feature of the invention, the transducers are spatially distributed on the front surface so as to allow homogeneous flow of the fluid in the volume of the cooling chamber.

According to this feature, the spatial distribution of the transducers is selected with the view of allowing a homogeneous flow of the coolant liquid in all the cooling space.

According to a particular feature, as the front surface of the insonification device has the shape of a planar or bulging disc, the transducers are distributed on a spiral or on a plurality of spirals centered on the centre of the disc.

With this distribution, it is possible to ensure circulation of the homogeneous fluid between the turns of the spiral or between each spiral.

According to an advantageous feature of the invention, the cooling chamber comprises at least one inlet and one outlet for the coolant fluid.

Such a feature allows renewal of the coolant fluid and activation of the circulation of the fluid by a pump external to the insonification device.

According to a preferential feature of the invention, the position(s) of the fluid inlet(s) and the position(s) of the fluid outlet(s) are selected depending on the distribution of the transducers in order to allow homogeneous flow of the coolant fluid in the space of the cooling chamber.

This feature, taking into account the distribution of the transducers for introducing and discharging the coolant fluid, allows optimization of the heat exchanges between the transducers and the coolant fluid.

Thus, preferentially, when the transducers are distributed on a spiral or on a plurality of spirals centered on the centre of a disc, the chamber comprises as many inlets are there are spirals and an outlet placed at the centre of the disc.

More generally, by multiplying the inlets or the outlets, it is possible to better distribute the circulation of the fluid. With this feature, it is possible to force homogeneous flow of the coolant fluid by maximally utilizing the spatial distribution of the transducers.

According to a preferential feature of the invention, the number of inlets for the coolant fluid is larger than the number of outlets.

Indeed, when a pump is used for circulating the fluid, considering that the admissible pressure at the pump inlet is lower than the pump outlet pressure, it is desirable, in order to provide homogeneous circulation of the fluid, to multiply the number of inlets for the coolant fluid in the cooling chamber rather than multiply the number of outlets. It is noted that the distribution geometry on several spirals is then particularly adapted to applying a homogeneous circulation of the fluid.

According to an advantageous feature of the invention, the chassis is divided into two matrices, a front matrix and a rear matrix, the front matrix supports the front end of the transducers and the rear matrix supports the rear end of the transducers.

With this feature, it is possible to build the cooling chamber in a particularly simple way, which is then arranged between both front and rear matrices upon mounting the insonification device, by the very shape of both front and rear matrices. In order to complete the mounting of the device, the bodies of the transducers are then introduced into the orifices provided for this purpose, facing each other, on each of the front and rear matrices. The front matrix thus supports the so-called front end of the transducers, on the acoustic emission side, and the rear matrix supports the rear end of the transducers on the side of the exit of the power supply cable(s).

Advantageously, the front matrix is made with a thermal conducting material, and the rear matrix is made with a heat insulating, optionally transparent material.

With these features, at the front face, it is possible to increase dissipation of energy on the heat conducting matrix.

On the other hand, as the heat insulating matrix forms the rear portion, condensation and therefore presence of moisture may be avoided at the components located at the rear of the device, and also unnecessary heating of these components which may be deteriorated therefrom.

Advantageously, the chassis is provided with means for measuring temperature in various locations inside the cooling chamber.

With this feature, absence of heating may be ensured by controlling the flow rate and temperature of the fluid sent towards the cooling chamber. The control of the flow rate and of temperature of the coolant fluid can be achieved by tracking the temperature as monitored in the cooling chamber.

According to an advantageous feature of the invention, the cooling chamber is such that it includes at least one partition of the same width or narrower than the bodies of the transducers and connecting the bodies of the transducer elements so as to define a preferential path for the coolant fluid.

Thus advantageously, these partitions which may occupy the entire height of the cooling chamber, or only an intermediate height, connect assemblies of transducers. With this feature of creating preferential forced paths, controlled flow of the fluid may be ensured within the cooling chamber.

Advantageously, when one or more spirals are used for distributing these transducers, the partitions connect the transducers borne by a same spiral.

According an additional advantageous feature of the invention, the insonification device further comprises at least one peripheral fluid inlet and one central fluid outlet crossing the cooling chamber in order to apply a conventional system for cooling the front surface of the device and the casing of the medium to be insonified.

Such a conventional cooling system conventionally applies a membrane forming a leakproof pocket with the front surface in which a coolant fluid circulates. With this pocket, acoustic coupling may also be achieved.

This additional cooling circuit, independent of the cooling chamber, has the advantage of cooling the transducers through their front face. The provided cooling will add to the one provided by the cooling chamber according to the invention. Here also, with the multiplicity and peripheral spatial distribution of the cooling inlets it is possible to obtain effective and homogeneous cooling of the membrane in contact with the medium to be insonified.

According to an advantageous feature of the invention, a hole with a large section is made on the front surface, followed by a conduit passing through the cooling chamber, so as to be able to rapidly discharge the air bubbles trapped during the filling of the conventional system for cooling the front surface.

Air bubbles at the front face may indeed strongly interfere with the propagation of ultrasound. As air has a lower density than water and that the device is generally used in such a position that its axis of revolution is substantially horizontal, this debubblizing system is advantageously placed on a high position of the insonification device during its use so as to discharge the air bubbles more easily.

The coolant fluid used may be according to the invention selected from the following fluids: water, water comprising additive(s) with which its heat capacity and/or its heat conduction may be increased and so the cooling efficiency, heavy water, these liquids flowing in circuits made with materials observing the constraints required by these liquids, gases which may be used under pressure and in circuits made with materials observing the constraints required by these gases.

Advantageously, the additives will be compatible with medical applications.

Advantageously, the fluid is cooled by a refrigerating device placed upstream from the device according to the invention.

SHORT DESCRIPTION OF THE DRAWINGS

Other features and advantages of the present invention will become apparent from the description made below with reference to the appended drawings which illustrate an exemplary embodiment thereof without any limiting character.

Wherein:

FIG. 1 illustrates a perspective sectional view of a first embodiment of an insonification device according to the invention;

FIGS. 2A and 2B provide a front view and a perspective sectional view of an insonification device according to a preferential embodiment of the invention;

DETAILED DESCRIPTION OF AN EMBODIMENT

Figure 1:
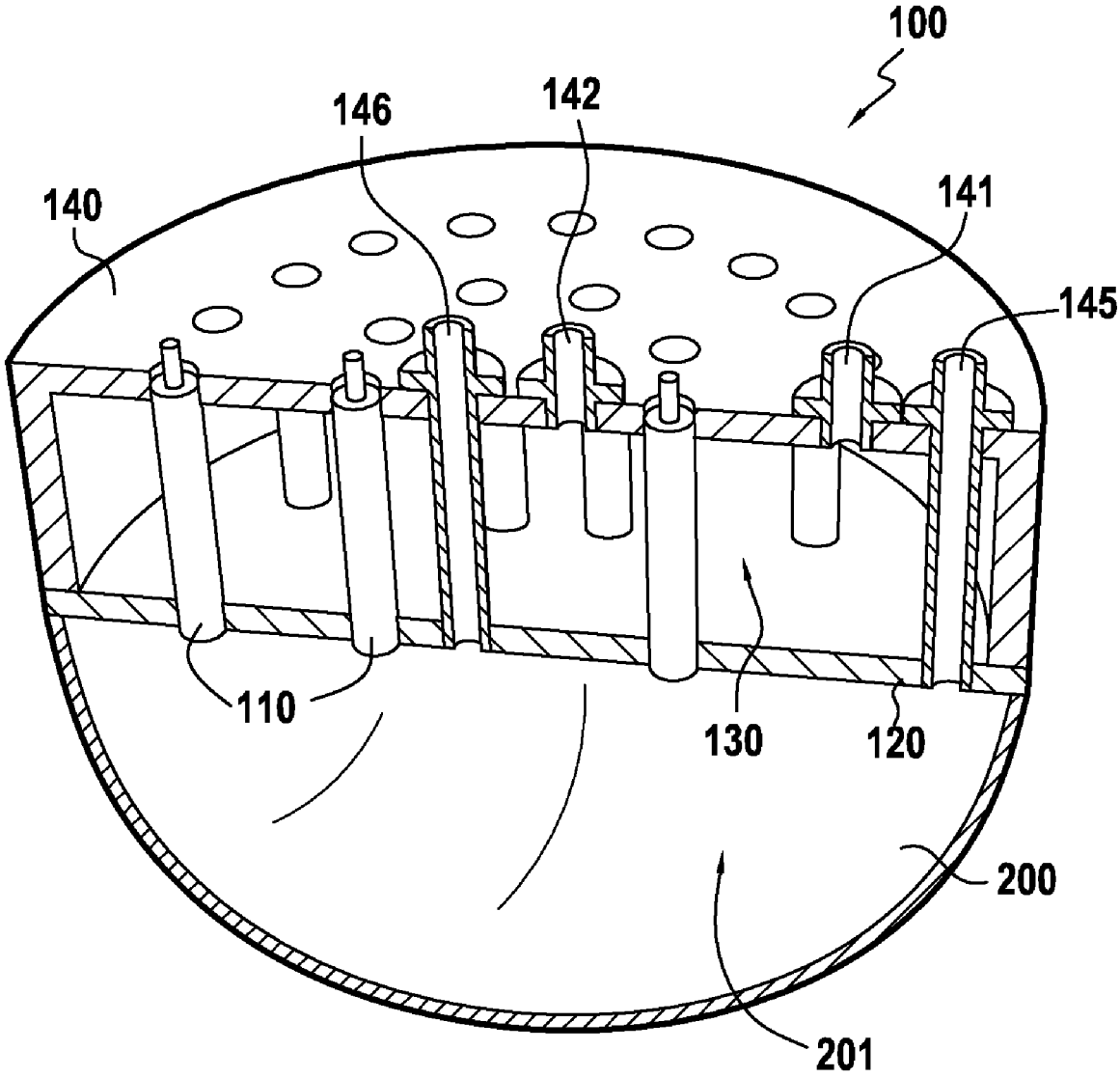

FIG. 1 illustrates a perspective sectional view of an insonification device 100, according to a first embodiment of the invention.

The device 100 comprises a chassis, here consisting of a front matrix 120 and of a rear matrix 140, defining between them a so-called cooling chamber 130. This chamber 130 is crossed by a plurality of elementary ultrasonic transducers 110 that are thus passing through said cooling chamber according to the invention. Each transducer thus has a so-called front end intended to be slid into an orifice made for this purpose in the front matrix 120 and a rear end intended to be slid into an orifice made for this purpose in the rear matrix 140.

Various materials may be used for making the front 120 and rear 140 matrices of the insonification device 100 according to the invention. In particular the front matrix 120 may be made from a resin filled with glass, carbon, or further a metal, for example aluminium or titanium. The heat conductivity properties of the matrix may thereby be modified and optionally its electric conductivity characteristics.

In all cases, when the material forming the front matrix 120 is capable of generating electric shocks by contact of a technician or a patient on the front matrix, it will be desirable to have the front surface 120' of the front matrix 120 covered with an insulating material coating in order to avoid discharges, except in the case when the material forming the front matrix is a perfect conductor or a perfect insulator.

The material, from which the rear matrix 140 of the device is made, advantageously is an insulating material providing heat insulation with the rear of the probe 100 which generally comprises electric and electronic components sensitive to hygrometry and temperature.

Advantageously, the rear matrix 140 is made in plastic, so that this matrix may notably be made optically transparent allowing visual inspection of the chamber 130.

In a particular embodiment of the invention where the probe 100 is expected to be used in combination with magnetic resonance imaging, the materials making up the chassis as well as the transducers 110 are selected from non-ferromagnetic and/or non-metal materials so as not to generate magnetic susceptibility artefacts and not to induce electromagnetic phenomena such as eddy currents. Resins and ceramics are such materials which will then be preferred.

In embodiments not intended to be used in combination with imaging using magnetic resonance, ferromagnetic and/or metal materials may then also be used, for example lightweight metals, including aluminium and titanium, for making up the chassis.

According to the advantageous embodiment illustrated in FIG. 1, the cooling chamber 130 made between the matrices 120 and 140 has an inlet orifice 141 and an outlet orifice 142 for a coolant liquid. With this, it is possible to renew the liquid in contact with the body of the transducers and to modulate the flow rate of the liquid. In addition, the temperature of the fluid which flows in the cooling chamber may thereby be controlled by external elements, for example a refrigerating circuit.

The chassis is further advantageously provided in various locations with means for measuring temperature. With these, the heating of the device may be tracked, and the flow rate or temperature of the fluid flowing in the cooling chamber 130 may be modified if necessary.

Advantageously, the cooling chamber 130 is further crossed right through by inlets and outlets 145 and 146 for a coolant fluid intended to flow outside the insonification device at the outer surface of the front matrix in an external chamber 201 materialized by the presence of a sealed membrane 200 in FIG. 1. In this figure, this so-called external chamber is delimited by this membrane 200 on its lower portion and by the front surface 120' of the front matrix 120.

These inlets and outlets 145 and 146 correspond to the application of a conventional cooling system in which the external chamber 201 defined by the membrane 200 also fulfils the indispensable acoustic coupling function with the insonified medium which is conventionally put into contact with the membrane 200.

According to the invention, the plurality of transducers 110 are distributed along the chassis so that the front ends of the transducers 110 are distributed according to a homogenous density on the outer surface of the front matrix 120. This outer surface is intended to be placed facing the medium to be insonified.

Figure 2A:
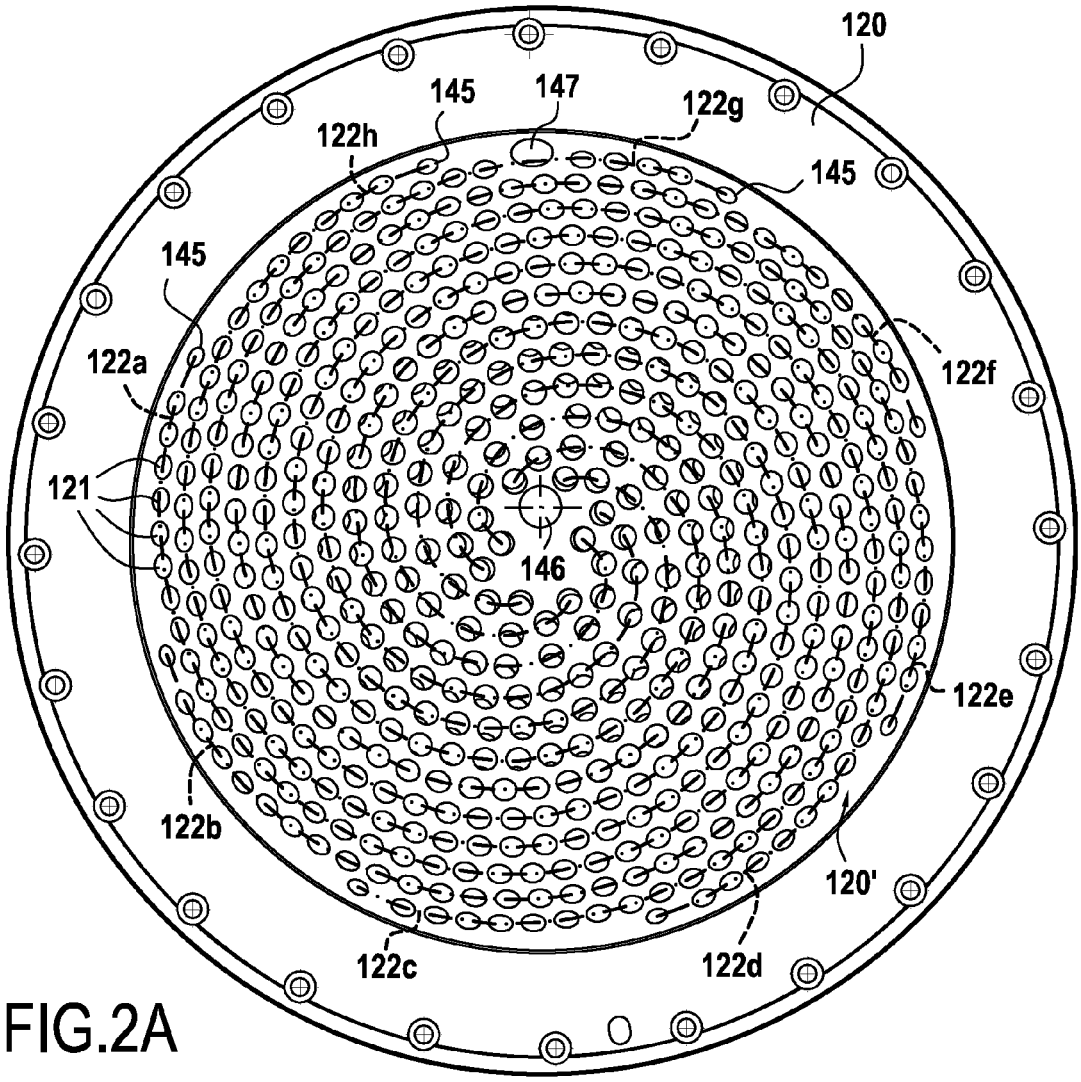
Figure 2B:
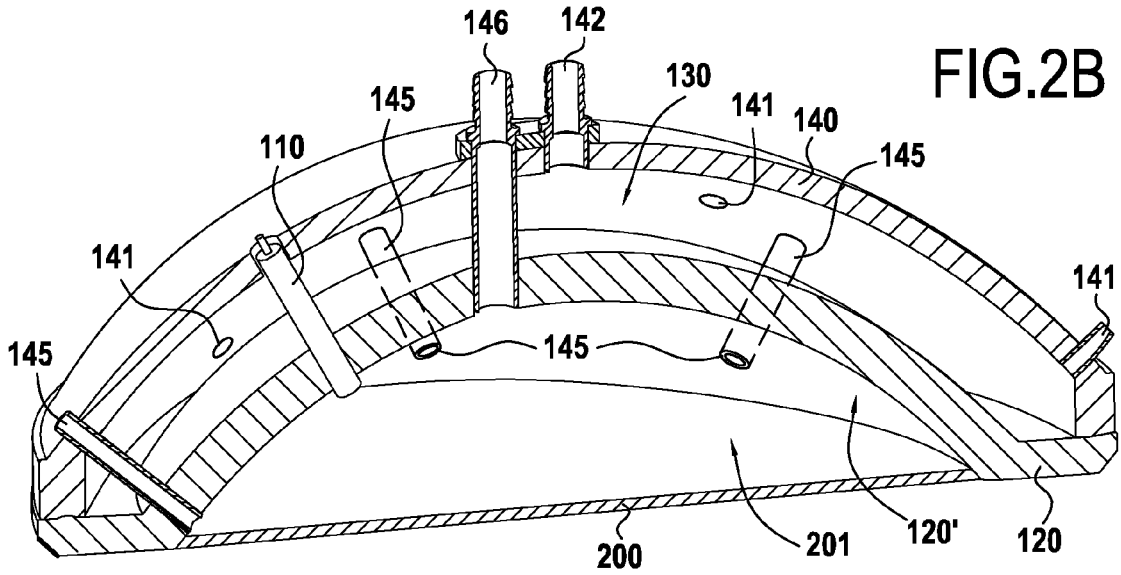

FIG. 2 illustrates a preferential embodiment of an insonification device according to the invention wherein the transducers 110 are distributed along a plurality of spirals. FIG. 2A is a front view of the outer surface of the front matrix 120 of such a device. As schematically described in FIG. 2B, this front matrix 120 has the shape of a concave bulging disc.

This front matrix 120 comprises orifices 121 for positioning the transducers 110 distributed along eight concentric spirals 112*a*-122*h*, the centre of which is placed at the centre of the disc forming the front surface 120' of the insonification device 100.

The front matrix 120 further has as many inlet orifices 145 for the coolant fluid in the external chamber 201 of the conventional cooling system as there are spirals 122 and an outlet orifice 146 for the coolant fluid from the external chamber 201, this orifice 146 being placed at the centre of the disc.

Advantageously, a hole 147 with a large section is made on the front face, followed by a conduit crossing the cooling chamber so as to be able to rapidly discharge air bubbles trapped during the filling of the front portion of the transducer, i.e. upon filling the external chamber 201 located between the front surface 120' of the matrix 120 and the membrane 200. Air bubbles at the front face may indeed strongly interfere with propagation of ultrasound. During use of the insonification device, the debubblizing system is advantageously placed on a high position as regards gravity, so as to discharge the air bubbles more easily, air having a lower density than water.

According to the preferential embodiment of the invention, the insonification device 100 also comprises as many inlets 141 for the coolant fluid in the chamber 130 as there are spirals 122. These inlets 141 are then placed on the periphery of the rear matrix 140 of the insonification device 100 in a similar way to the inlets 145 in FIG. 2 and in proximity to the latter. The inlets 141 are then distributed at regular distances on the periphery of the rear matrix 140.

Thus, each inlet 141 is intended to provide with coolant fluid the interval between the turn of the spiral 122*i* and the turn of spiral 122*i*+1. The fluid is then sucked up by an outlet 142 placed at the centre of the rear matrix of the insonification device.

In the absolute, these inlets and outlets 141 and 142 may be inverted. Nevertheless, because of the suction behaviour of the pumps likely to be used with the insonification device according to the invention, it is preferable to only have a single outlet for the coolant fluid.

Indeed, if the fluid inlet were placed in the centre of the disc, it would be difficult to ensure proper distribution over the whole of the eight spirals. The thrust pressure would not be able to ensure equal distribution among the paths defined between the eight spirals and the strong pressure loss upon suction would not allow this problem to be corrected. The preferential path of the coolant flow is thus easier to obtain by injecting the liquid through eight nozzles than by sucking it up through these eight nozzles.

The same remarks on hydrodynamics are valid for the single outlet 146 made at the centre of the insonification device and the plurality of inlets 145 for the fluid in the outer chamber of the conventional cooling system, distributed on the periphery of the insonification device.

The distribution of the transducers 110 over the spirals 122, associated with the feature according to which the insonification device is provided with as many inlets 141 as there are spirals 122, these inlets being placed at each peripheral end of the spirals 112*a*-122*h*, provides homogeneous flow of the coolant fluid in the whole space of the cooling chamber 130 and heat exchange with each of the transducers.

It is worth emphasizing that the use of a distribution of transducers along one or more spirals is an original innovation allowing both proper cooling of the transducers according to the invention and very good acoustic efficiency, as well as moreover protected by the applicants.

FIG. 3 shows examples of transducers 110 intended to be used in an insonification device according to the invention.

All the shown transducers comprise at their front end an electro-acoustic element 111, advantageously provided with a quarter wave plate 112, and a body 113 with a cylindrical section longitudinally extending in a direction perpendicular to the surface of the electro-acoustic element 111. The electro-acoustic element 111 generates the acoustic emission useful for operating the insonification device. At the rear of each transducer, means are provided for the exit of electric power supply cables.

Figure 3A:
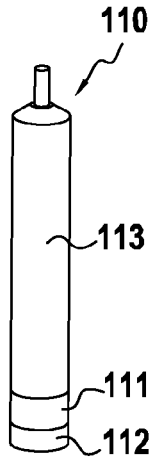
FIGS. 3A-3D show examples of elementary transducers as used in the insonification devices according to the invention.

FIG. 3A illustrates the simplest embodiment of a transducer 110 used in a device according to the invention. This transducer has a body 113 with a homogeneous circular section.

According to the invention, it is important to select the material making up the body 113 of the elementary transducer 110 according to its thermal characteristics in order to obtain maximum heat transfer towards the coolant fluid. Such a material will therefore advantageously have high heat conductivity as well as strong heat capacity.

Figure 3B:
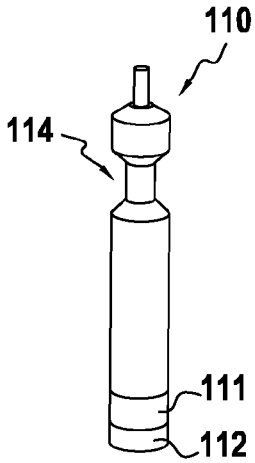

According to a preferential embodiment of the invention illustrated in FIG. 3B, the transducer 110 comprises a neck 114 which is formed by shrinking the diameter of the longitudinal body 113 of the transducer 110.

It is seen in FIG. 3B that the neck 114 is made in the rear position on the body 113 of the transducer 110. This feature meets the constraints on the structure of the transducer 110. Nevertheless, the neck 114 will advantageously be produced as close as possible to the electro-acoustic element 111, a source of heat.

Figure 3C:
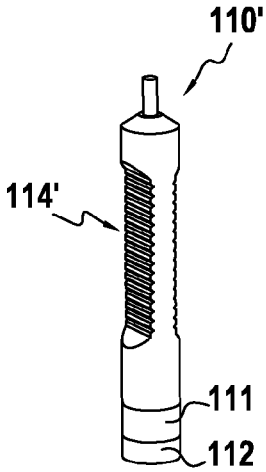

FIG. 3C shows another embodiment of a transducer 110 according to the invention. According to this embodiment, the transducer 110 is shrinked in volume along a direction which corresponds to the preferential direction of flow of the fluid along the transducer 110. This direction of flow then has to be known at each transducer 110 in order to be able to properly place and orient each transducer 110 relatively to the fluid flow. This requires high accuracy upon mounting the insonification device 100 but this allows optimization of the exchange surface at the neck 114 and limitation of the pressure losses.

Figure 3D:
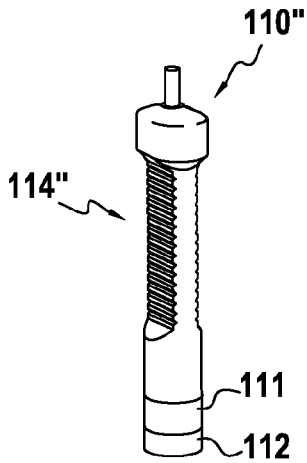

In order to facilitate orientation of the transducers, it will be advantageously provided that the bodies 113 of such transducers 110 and the orifices made in the rear matrix 140 be of non-circular section. This section may for example be an oblong section, the orientation of the major axis of which is known relatively to the direction along which the neck is made. It is then sufficient to place the transducers so that their rear end enters the provided orifice so that the latter is oriented relatively to the fluid flow provided in the cooling chamber 130. In such an embodiment as illustrated in FIG. 3D, the front end of transducers 110 is, on the other hand, circular. Other orientation aids may nevertheless be applied in the invention, for example a line or a notch aligned with the perpendicular to the direction of the neck, i.e. aligned with the expected flow direction of the coolant fluid.

In FIG. 3C, the whole portion of the body of the transducer 110 intended to be present in the cooling chamber 130 was shrinked. This is advantageous because this increases in proportion the exchange surface with the coolant fluid.

In addition, in this figure, the surface of the neck 114 is microgrooved in order to increase the exchange surface with the coolant fluid. Such microgrooving or milligrooving may advantageously be performed on any type of neck 114 of a transducer 110 intended to be applied according to the invention.

In the preferential embodiment schematized in FIG. 2, as the front surface 120' of the front matrix 120 is a surface with the shape of a bulging disc, concave on its outer side, the transducers are therefore arranged as a "fan-out" in the cooling chamber. The so-called front end of the transducers 110 is then closer than their rear end. Advantageously, each transducer 110 will then have a neck as close as possible to the heat source i.e. towards the front end of the transducer 110. Nevertheless, as the bodies of the transducers 113 are made in a heat conducting material, it is possible to use transducers according to FIG. 3B. In this case, the neck 114 positioned towards the rear end of the transducer 110 is placed at the level where the fanned-out transducers are the furthest away from each other in the cooling chamber. Thus with such a neck 114, fluid flow is provided with reduced hydraulic resistance as compared with an identical neck made towards the front end of the transducer 110. This is advantageous even if the neck is positioned away from the heat source.

Indeed, it is known that the hydraulic resistance generated by an obstacle placed in a flow is proportional to the distance raised to the power of 4. Also, when the distance between the transducers is of the order of 1 mm, a differential pressure is observed between before and after the obstacle of the order of 2 bars, whereas if the distance is increased to between 2 and 3 mm, the differential pressure falls to a pressure below 1 bar, and generally is of the order of 0.1 bar.

As in the insonification device in accordance with the invention according to FIG. 1, the distance between the transducers is globally of the order of 1 mm when no necking is performed, by using a neck for facilitating fluid flow it is possible to obtain an apparent separation of the transducers by a distance ranging from 2 to 3 mm. This distance is sufficient for allowing efficient and increased flow of the fluid at the rear end of the transducers 110. In the case when the transducers are fanned out, as illustrated in FIG. 2, this advantage is less substantial if the neck 114 is made at the rear end of the transducer 110.

Considering the foregoing, it is understood that the use of transducers comprising a neck over the whole portion of the body 113 intended to be placed within the cooling chamber is the most advantageous option when this is possible.

In a particular embodiment of a transducer intended to be used in a device according to the invention, the shape of the body of the transducer is adapted to the relative arrangement of the transducers with respect to each other. In the case of fanned-out transducers, the body 113 of each transducer 110 may in particular be of conical shape.

Figure 4:
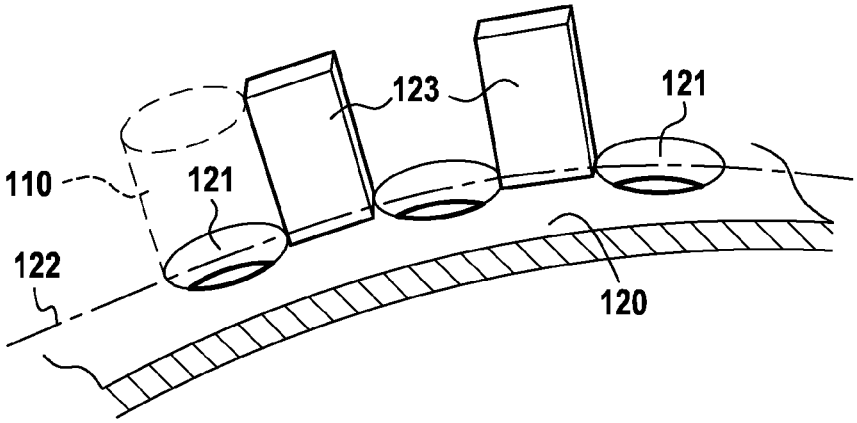
FIG. 4 illustrates a detailed perspective view of the inner surface of the cooling chamber of the front matrix of a device according to an advantageous embodiment of the invention.

FIG. 4 shows a particular characteristic of the invention according to which, at least, one of the front or rear matrices, here the front matrix 120 as seen from the inside of the cooling chamber, is provided with partitions 123 capable of connecting the transducers 110 when they are introduced into the orifices 121. With these partitions 123, it is possible to ensure controlled flow of the coolant fluid by entirely guiding the fluid between the transducers 110 along one or more preferential paths. In FIG. 4, the preferential paths are those which pass between the spirals 122 on which the transducers 110 are distributed.

Concerning the selection of the coolant fluids, any fluid having significant heat capacity is suitable provided that it is compatible with the intended applications for the use of the insonification device according to the invention, in particular from a sanitary point of view, notably as regards constraints on hygiene and safety, in the case of an accidental leak.

Among the set of coolant fluids which may be used, mention may be made of: water, water with additives, preferentially medically compatible, heavy water, gases which may be used under pressure and in circuits made with materials observing the constraints required by these gases, etc.

The possibility of using liquid at low pressure is nevertheless generally desirable so as to allow easy application of the insonification device according to the invention.

Additionally, it should be noted that in the case when the insonification device is used in combination with an imaging system using magnetic resonance at the resonance frequencies of the hydrogen bonds in water, the use of water as a coolant fluid poses a problem. Water is then actually a cause of artifact on the images.

As for imaging certain media, notably living organic media, there are no other usable resonance frequencies; it is desirable that, when it is desired to use an insonification device on such a medium, the coolant fluid should not have any molecular bonds capable of resonating at the resonance frequency of water.

A proton-free liquid associated with oxygen will then be used. Thus, the use of heavy water as a coolant fluid may be contemplated since the magnetic resonance frequency of deuterium is significantly different from that of hydrogen.

It is finally noted that various applications may be achieved according to the principles of the invention as stated in the following claims.

The invention claimed is:

1. An insonification device comprising a plurality of elementary ultrasonic transducers each comprising at least one electro-acoustic element, the plurality of transducers being distributed on a chassis so that the electro-acoustic elements are distributed on a front surface of the device extending over at least two dimensions for facing a medium to be insonified on a first side of the front surface, characterized in that, each transducer comprises a longitudinal body made in a heat conducting material at a front end of which the electro-acoustic element is placed, the chassis comprises a cooling chamber placed on a second side of the front surface, and into which the bodies of the transducers are positioned and configured to be exposed to a flow of coolant fluid to cool the bodies of the transducers.

2. The device according to claim 1, characterized in that the bodies of the transducers are profiled so as to facilitate circulation of the fluid.

3. The device according to claim 2, characterized in that the bodies of the transducers have a neck in at least a direction, perpendicular to the flow rate, in order to reduce hydraulic resistance.

4. The device according to claim 1, characterized in that the bodies of the transducers have a surface geometry providing an exchange surface with the fluid, greater than the exchange surface corresponding to a surface geometry corresponding to a homogeneous and constant section along the transducer.

5. The device according to claim 1, characterized in that, as the chassis comprises as many orifices at the rear of the insonification device as there are elementary transducers, the transducers are removably attached through the cooling chamber.

6. The device according to claim 1, characterized in that the bodies of the transducers are made in a material selected from the following heat conducting materials: metals, ceramics, filler-loaded resins.

7. The device according to claim 1, characterized in that the transducers are spatially distributed on a rear surface so as to allow a homogeneous flow of the fluid in the space of the cooling chamber.

8. The device according to claim 7, characterized in that, as the front surface of the insonification device has the shape of a planar or bulging disc, the transducers are distributed on a spiral or a plurality of spirals centered on the centre of the disc.

9. The device according to claim 1, characterized in that the cooling chamber comprises at least one inlet and one outlet for coolant fluid.

10. The device according to claim 9, characterized in that the position of one or more inlets for the coolant fluid and the position of one or more outlets for the coolant fluid are selected depending on the distribution of the transducers in order to allow homogeneous flow of the coolant fluid in the space of the cooling chamber.

11. The device according to claim 8, characterized in that the cooling chamber comprises as many external inlets as there are spirals and an outlet placed at the centre of the disc.

12. The device according to claim 9, characterized in that the number of inlets for the coolant fluid is greater than the number of outlets.

13. The device according to claim 1, characterized in that, as the chassis is divided into two matrices, a front matrix and a rear matrix, the front matrix supports the front end of the transducers and the rear matrix supports the rear end of the transducers.

14. The device according to claim 13, characterized in that, the front matrix is made from a heat conducting material and the rear matrix of the chassis is made from a heat insulating material.

15. The device according to claim 1, characterized in that the chassis is provided with means for measuring temperature in various locations inside the cooling chamber.

16. The device according to claim 1, characterized in that the cooling chamber is such that it includes at least one wall of the same width or narrower than the bodies of the transducers so as to define a preferential path for the coolant fluid.

17. The device according to claim 16, characterized in that the walls connect the transducers borne by a same spiral.

18. The device according to claim 1, characterized in that it further comprises at least one inlet and one outlet for a coolant fluid, said at least one inlet and one outlet crossing the cooling chamber for applying a system for cooling the front surface of the device and a casing of the medium to be insonified.

19. The device according to claim 18, characterized in that a hole of large section is made on the front surface followed by a conduit crossing the cooling chamber, so as to be able to rapidly evacuate the air bubbles trapped during filling of the system for cooling the front surface.

20. The device according to claim 1, characterized in that the fluid used for cooling the front surface of the device is selected from the following fluids: water, water including one or more additives with which heat capacity and heat conductivity may be increased, heavy water, these liquids flowing in circuits made with materials observing the constraints required by these liquids, gases which may be used under pressure and in circuits made with materials observing the constraints required by these gases.

21. The device according to claim 1, characterized in that the fluid is refrigerated with a refrigerating device placed upstream from the device.

* * * * *